United States Patent [19]

Arciniega Blanco

[11] 4,016,817

[45] Apr. 12, 1977

[54] BULLET FOR HUNTING SHOTGUNS

[76] Inventor: Moisés Arciniega Blanco, Telemaco, 18, Madrid-27, Spain

[22] Filed: Oct. 10, 1975

[21] Appl. No.: 621,618

[52] U.S. Cl. ..... 102/92.4; 102/38; 244/3.23

[51] Int. Cl.[2] ..... F42B 11/02

[58] Field of Search ..... 102/38, 42 R, 92.1–92.7, 102/93; 244/3.23

[56] References Cited

UNITED STATES PATENTS

| | | | |
|---|---|---|---|
| 2,356,227 | 8/1944 | Diehl | 102/92.6 |
| 2,414,863 | 1/1947 | Foster | 102/92.4 |

FOREIGN PATENTS OR APPLICATIONS

| | | | |
|---|---|---|---|
| 665,259 | 6/1965 | Belgium | 102/92.4 |
| 1,253,485 | 3/1960 | France | 102/92.4 |

*Primary Examiner*—Harold Tudor
*Attorney, Agent, or Firm*—Wenderoth, Lind & Ponack

[57] ABSTRACT

A bullet includes a conical steel tip having an interiorly thread projection extending into a socket of a lead cylindrical intermediate element, a base end of which has a hole and slot to receive a corresponding projection and rib of a plastic cylindrical rear element. Exterior surfaces of the intermediate and rear elements have formed therein a plurality of inclined grooves to achieve rotation of the bullet. A base end of the rear element is concavely recessed to receive gases resulting from the combustion of powder. A threaded pin extends through the rear and intermediate elements and is threaded into the projection of the tip.

11 Claims, 5 Drawing Figures

BULLET FOR HUNTING SHOTGUNS

BACKGROUND AND SUMMARY OF THE INVENTION

The present application relates to an improved bullet for hunting shotguns. The bullet of the invention produces an important advantage in relation to known projectiles, mainly with regard to the line of trajectory, greater reliability in hitting the target, effectiveness of its impact, penetration and killing capacity. At the same time, it is possible to achieve a greater economy due to saving of material and simplicity of assembly.

The bullet of the invention basically includes three independent elements that are joined by means of a screw or pin and have such a shape as to form a single piece which is mounted, without the need of a wad, in an ordinary cartridge case that is generally used for the type of porjectiles fired from smooth-bore or barrel shotguns.

The three pieces or elements are:

A steel tip arranged at the front end of the bullet and having a conical configuration with a projection extending from the base of the cone. The projection has a threaded opening for receiving the end of a screw or pin which connects the elements into a whole.

A lead intermediate element of cylindrical shape and having an outer surface is provided with a series of inclined grooves that end in a sharp edge, for the purpose of rotating the projectile, which is not achieved by known bullets fired from smooth-bore weapons. In its upper portion, the lead element is provided with a socket for receiving the projection of the steel tip, while in the base or lower end of the lead element has a hole in the shape of a truncated cone and a safety groove. The hole receives a projection or head of a lower element.

A lower or rear element made of plastic is employed as an end or tail of the projectile. It is cylindrical in cross section and has a plurality of inclined grooves on its outer surface, the grooves corresponding in arrangement to those of the lead element. The diameter of the rear element is slightly larger than the diameter of the lead element. The rear element has at the leading end thereof a head or projection that perfectly fits the hole of the lead element. The projection includes an insertion blade extending into the safety groove for preventing rotation or slipping of the elements when assembled. At its lower end the rear element is provided with a recess having an inward concave shape. The recess will be engaged by gases resulting from the combustion of powder, which will expand the edges of the rear element in order to provide a better use of the energy of such gases and to prevent their escape between the projectile and the walls of the barrel of the weapon.

The three elements are joined by means of a threaded pin which is inserted through the lower end of the plastic element, passes through the lead element and is screwed into the threaded opening in the projection of the upper steel point, so as to obtain a very compact solid member having a low weight and possessing improved ballistic properties.

The features of the bullet of the invention will be described in more detail with reference to the attached drawings that correspond merely to a single embodiment given by way of example only, without being restrictive of the scope of the invention. The shape, dimensions and materials of which the separate parts of the bullet are made will in each case be those considered suitable for the application in question, and such modifications, including those made of the details of presentation and arrangement, are to be considered as being within the scope of the invention.

DETAILED DESCRIPTION OF THE INVENTION

Figure 1:
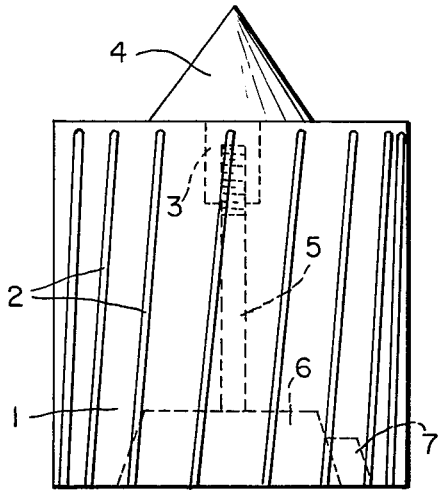
FIG. 1 is an elevation view of the lead element with the mounted steel point.
Figure 2:
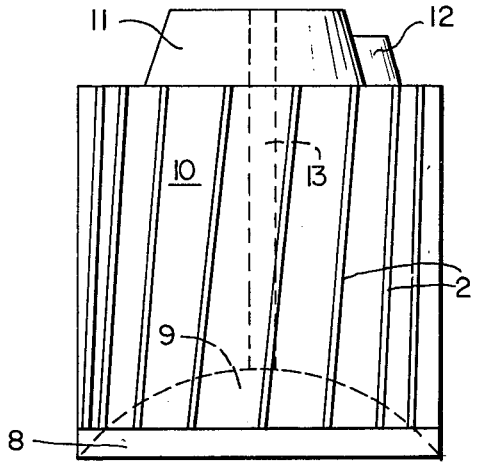
FIG. 2 ia an elevation view of the lower pastic element.
Figure 4:
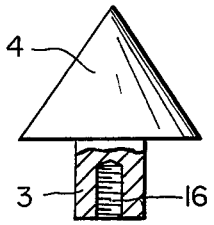
FIG. 4 is an elevation view, partially in section, of the steel point.
Figure 5:
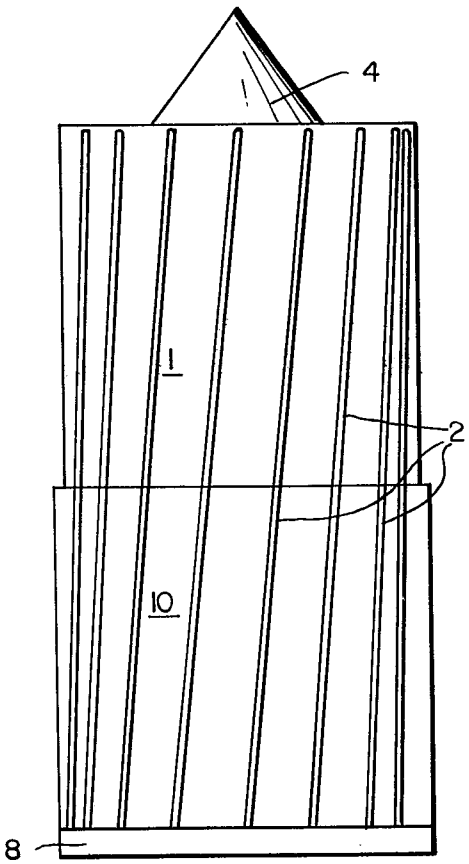
FIG. 5 is an elevation view of the entire arrangement in assembled form.
Figure 3:
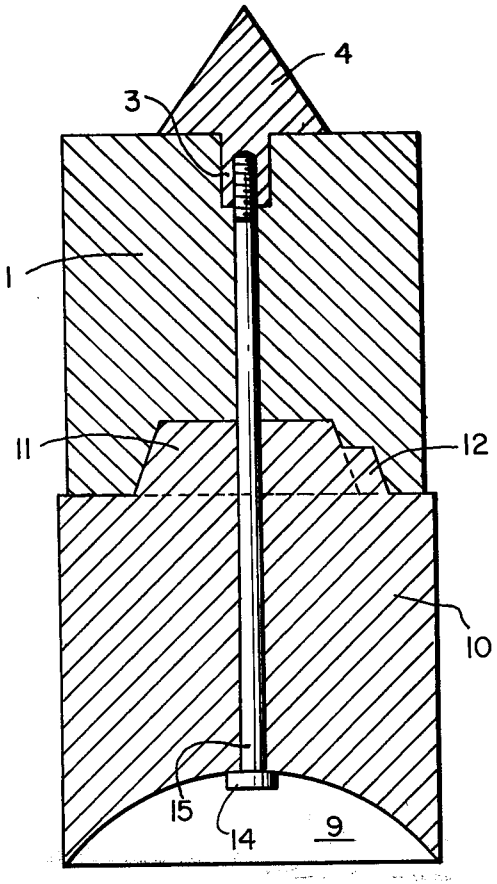
FIG. 3 is a longitudinal section of the entire arrangement in assembled form.

The following description is made with reference to the attached drawings, and the reference numerals employed therein designate the parts and details of the illustrated bullet that are of importance for the purposes of explaining the present invention.

The bullet of the invention includes a steel point 4 which is provided with a lower extension 3 having therein a threaded opening 16 for receiving the end of a joining screw 15. The point 4 is mounted in a lead element 1 the surface of which is provided with a series of inclined grooves 2, so that it rotates when colliding with air. The base of element 1 has therein a hole 6 in the shape of a truncated cone with a safety slot connected to the cone. A lower plastic cylindrical element 10, whose diameter is slightly larger than upper lead element 1, has a projection 11 and rib 12 which respectively fit into conical hole 6 and slot 7. Element 10 has grooves 2 which also produce the effect of rotation. The lower portion of the plastic element 10 is provided with a peripheral reinforcing edge 8, and the base of the element 10 has an inwardly extending concave recess 9.

In order to form a solid unitary projectile body, the three elements 4, 1 and 10 are joined by means of a threaded pin 15, which is mounted with its head 14 in concave base 9 of plastic element 10, passes through a central vertical hole 13 of element 10 and joins it to lead element 1, likewise passes through hole 5 in element 1, and is screwed into opening 16 of extension 3 of steel point 4.

I claim:

1. A bullet for hunting shotguns, said bullet comprising:

a conical tip member having a pointed forward end and an interiorly threaded base end;

a cylindrical intermediate element separate from said tip member and having in the outer surface thereof a plurality of inclined grooves, said intermediate element having a forward end joining said base end of said tip member and a base end;

a rear cylindrical element separate from said intermediate element and having in the outer surface thereof a plurality of inclined grooves, said rear element having a forward end joining said base end of said intermediate element and an inwardly and concavely recessed base end; and threaded pin means, having a head positioned in said recessed base end of said rear element, extending longitudinally through said rear element and said intermediate element and threaded into said threaded base end of said tip member, for connecting said tip member, said intermediate element and said rear element into a unitary projectile.

2. A bullet as claimed in claim 1, wherein said tip member is formed of steel.

3. A bullet as claimed in claim 1, wherein said intermediate element is formed of lead.

4. A bullet as claimed in claim 1, wherein said rear element is formed of plastic.

5. A bullet as claimed in claim 1, wherein said tip member is formed of steel, said intermediate element is formed of lead, and said rear element is formed of plastic.

6. A bullet as claimed in claim 1, wherein said base end of said tip member has a projection extending therefrom, said projection having a threaded opening therein, and said forward end of said intermediate element has therein a recessed socket, said projection extending into said socket.

7. A bullet as claimed in claim 6, wherein said base end of said intermediate element has therein a hole and a slot connected to said hole, and said forward end of said rear element has extending therefrom a projection and a rib respectively extending into said hole and slot.

8. A bullet as claimed in claim 7, wherein said hole and said projection of said rear element each have the configuration of a truncated cone.

9. A bullet as claimed in claim 1, wherein said base end of said intermediate element has therein a hole and a slot connected to said hole, and said forward end of said rear element has extending therefrom a projection and a rib respectively extending into said hole and slot.

10. A bullet as claimed in claim 9, wherein said hole and said projection of said rear element each have the configuration of a truncated cone.

11. A bullet as claimed in claim 1, wherein said rear element has a diameter greater than the diameter of said intermediate element.

* * * * *